United States Patent [19]

Lynch

[11] Patent Number: 4,947,884

[45] Date of Patent: Aug. 14, 1990

[54] COLLAPSIBLE CANOPY WITH AUTO ERECT ROOF SUPPORT STRUCTURE

[76] Inventor: James P. Lynch, 13 S. Field, Lakewood, Colo. 80226

[21] Appl. No.: 356,111

[22] Filed: May 24, 1989

[51] Int. Cl.[5] ..... E04H 15/18

[52] U.S. Cl. ..... 135/97; 135/110; 52/109

[58] Field of Search ..... 135/97, 98, 103, 107, 135/109, 110, 111, 112, 113, 114, 900; 52/109, 646

[56] References Cited

U.S. PATENT DOCUMENTS

| | | | |
|---|---|---|---|
| 402,755 | 5/1889 | Lyon | 135/103 X |
| 4,558,713 | 12/1985 | Hagler et al. | 135/109 X |
| 4,611,946 | 9/1986 | Gebelius | 135/112 X |

FOREIGN PATENT DOCUMENTS

| | | | |
|---|---|---|---|
| 198803 | 6/1923 | United Kingdom | 135/111 |

*Primary Examiner*—David A. Scherbel
*Assistant Examiner*—Lan Mai
*Attorney, Agent, or Firm*—Timothy J. Martin

[57] ABSTRACT

A canopy shelter has a plurality of corner support forming legs that may be positioned on a support surface. Scissor assemblies interconnect adjacent ones of the corner supports and are each pivotally connected at one portion to the top ends of the respective corner supports and are each pivotally connected at another portion to slide brackets slideably mounted on each of the respective corner supports. Roof support members are pivotally connected to a respective slide bracket on a corner support. Thus, the framework may be collapsed in a stored state yet expanded to an expanded state by spreading the corner members apart from one another. This automatically raises the apex which may also include a center post structure. Latches are provided to retain the slide brackets in position to hold the framework in the expanded state. A flexible covering is centrally supported by the apex to form a canopy top, and cables may be provided between the top ends of the corner supports and the apex to further support the flexible covering. Side panels and a front panel having a doorway may be used to enclose a protected space. The corner supports may be formed by telescoping leg sections. Each roof support may be formed by a plurality of extendible sections that may be open and closed either by pivotally folding or by telescopic construction, and latches are provided to hold the roof sections open.

23 Claims, 4 Drawing Sheets

COLLAPSIBLE CANOPY WITH AUTO ERECT ROOF SUPPORT STRUCTURE

FIELD OF THE INVENTION

The present invention generally relates to collapsible shelters or canopy structures which may be used to temporarily supply shelter against the elements, to provide privacy and the like. Specifically, the present invention relates to a cabana style canopy that employs an automatically erecting roof support structure so as to be extremely fast in erection and take down. To this end, the present invention relates to those types of shelters which are self-contained and may be stored in a relatively small, collapsed state, but which may be expanded to an erect state without the need for manual assembly.

BACKGROUND OF THE INVENTION

Temporary shelters have gained increasing popularity in recent times, and the number of situational applications for these shelters continue to grow. Typically, these temporary shelters are those which include an assembled framework structures that collapse into a stored state that is relatively compact yet which expands into an erected state over a much larger surface are. A rood covering is provided for shade, for protection against the rain or other natural elements, or for other shelter purposes. Side panels may be used either to provide a display background or in the form of protective netting against insects, and other complementary structures may be employed with the basic framework to increase the application for these shelters. Shelters, such as those described with respect to the present invention, are often employed for purposes of recreation, fairs, bazaars, outdoor exhibitions, and food and beverage vending, to name a few.

One such example of an expandable, portable canopy shelter is shown in my U.S. Pat. No. 4,779,635, issued Oct. 25, 1988. The canopy structure shown in the preferred embodiment of that Patent shows a framework unit formed by a plurality of upright corner members that are expandably connected to one another by side-scissor assemblies, and, in an erected state, roof support members extend upwardly and radially inwardly, to a central apex. The roof support members are pivotally connected at one end to the apex and at the other end to a top of a respective upright corner member. The roof support members are expandable, preferably by telescoping with one another, and may be latched into an extended position when the canopy framework is erected. The canopy framework may be collapsed by moving the corner supports together. This is permitted since the scissor assemblies interconnecting the corner supports are on slide brackets. As the framework is collapsed, each roof support member is telescoped together and the apex portion is dropped from a peak position down through the horizontal plane defined by the upper ends of the corner supports. The apex continues to drop through center until it reaches a stored position wherein it is adjacent to the corner support members, which are in turn, adjacent to one another. In the erect state, a flexible covering extends over the roof support members and is supported by the framework.

Another example of an expandable/collapsible shelter is shown in my earlier U.S. Pat. No. 4,641,676. This Patent shows a portable canopy structure again having a framework that maybe collapsed into a stored state yet may be expanded and erected for use. The framework includes a plurality of upright support members which are interconnected by a plurality of edge scissor assemblies. An internal scissor assembly is provided to support a central post, and a flexible covering extends across the top of the supports and is supported at a center by the central post. The structure is also similar to that described in U.S. Pat. No. 4,607,656, issued Aug. 26, 1986 to Carter.

Although the structures shown in the above-referenced patents provide significant advantages over earlier prior art structures, especially in the relative ease of both expansion and collapse, these two types of structures nonetheless have some drawbacks. For example, with respect to the first described structure, Lynch #'635, the need to move the apex portion through the plane defined by the tops of the corner support members (i.e. "through center"), causes some inconvenience both during the erection of the structure and during its collapse. This procedure requires some manipulation of the roof support structure directly during the assembly and take-down of the device. On the other hand, the structure shown in Lynch #'676 patent and in the Carter patent has the disadvantage of including an internal scissoring structure which eliminates some of the headroom provided for persons sheltered by the canopy structure. Furthermore, both Lynch #'767 and Carter show structures that are under compressive forces so that, when the scissor assemblies are subjected to forces transversely of the scissor assembly plane, the combination of the two forces can result in substantial bowing of the scissor assemblies and distortion of the canopy framework.

Therefore, despite the advantages provided by the above-referenced structures and other shelter devices, there remains a need for a portable shelter, especially having a relatively small dimension, which can be quickly and easily erected and taken down. There is a further need for such a shelter framework wherein roof supports are erected automatically as the framework is expanded. There is a further need for an extremely light-weight structure which can be used as a cabana for such applications as a portable dressing room, manhole cover, latrine shelter, or shower enclosure.

SUMMARY OF THE INVENTION

It is an object of the present invention to provide a new and useful shelter apparatus which is light-weight and portable and which may be quickly erected for use and quickly taken down for storage in a compact size.

Another object of the present invention is to provide a strong, durable shelter device, in the form of a framework and flexible covering, which may be erected for use by simply expanding the framework.

Yet another object of the present invention is to provide a cabana type portable shelter, or relatively small dimension, which may be used where a relatively limited surface area is to be protected.

A still further object of the present invention is to provide an inexpensive portable shelter which may be used as a small vending station, as a changing room, as a manhole cover, and the like.

A still further object of the present invention is to provide a cabana type portable shelter which has a pleasing appearance and which may be erected in confined quarters, such as on sidewalks or other locations where only a minimum display area is available.

According to the present invention, then, a canopy structure is provided which is adapted to be folded and stored in a collapsed state yet erected in an expanded state on a support surface to shelter against the elements or to otherwise provide privacy. The canopy structure broadly includes a plurality of upright corner support members, each having a bottom end positionable on the support surface and the top end opposite the bottom end. The corner support members are oriented alongside one another in the collapsed state and are movable outwardly apart from one another toward the expanded state when the corner support members are oriented generally vertically on the support surface to define the perimeter of the area to be sheltered. A slide bracket is slideably mounted on each corner support member, and a scissor assembly interconnects adjacent ones of the corner support members for expansion and contraction. To this end, each respective scissor assembly has one portion pivotally connected to the top ends of its associated corner support members, and another portion pivotally connected to the slide brackets of its associated corner support members. Thus, each scissor assembly is operative to open and close when the associated corner support members move away from and toward one another, with each slide bracket advancing to a location proximate the top end of its respective corner support member when the corner support members are moved into the expanded state. Correspondingly, the slide brackets move toward the bottom end of the respective corner support members when the corner support members are moved into the collapsed state. A plurality of roof support members are pivotally connected to one another at first ends thereof to form an apex, and each roof support member is pivotally connected at a second end thereof opposite the first end to the slide bracket on a respective corner support member. Thus, advancement of the slide brackets to locations proximate the top ends of their respective corner support members causes the apex to be elevated with respective to the support surface. Likewise, advancement of the slide brackets towards the bottom ends of their respective corner support members causes the apex to be lowered with respect to the support surface. Latching structures, preferably in the form of buttom latches, are provided to retain each of the slide brackets at the location proximate the top ends of the respective corner support members.

A flexible fabric covering extends over the roof support members so as to provide a top for the canopy framework. The flexible covering is preferably formed out of a waterproof, light-weight fabric material, such as polyurethane; and the covering further has side margins that extend downwardly alongside the canopy framework at least to a bottom edge location proximate the slide brackets in the erect state. If desired, side panels may be connected across one or more sides formed by adjacent corner support members, with the side panels being securable to the bottom edge of the top covering. The extended side panels may be relatively opaque in order to provide privacy for the interior of the canopy framework, when assembled, or the side panels may be formed of a netting in order to protect against insects or to provide a relatively see through windscreen.

Preferably, in order to keep the flexible covering in a taut condition, a plurality of cables are employed to extend from the apex formed by the roof support members to each top end of the corner support members. These cables can either be elastic-cord elements or may be nonextendable metallic cables. The cables may be connected between the apex and the top ends of the respective corner supports so that they are automatically deployed when the canopy framework is erected, or, in the alternative, they may be releasably secured at one of the apex and the respective top end so as to be attachable after the framework is erected. Preferably, the apex is formed as a center post assembly terminating at an upper dome element, and the center post assembly may be spring-biased to further help maintain the flexible covering in a taut condition.

The scissor assemblies may either be formed as single-scissor elements comprising a pair of scissor bars, or by pairs of scissor elements connected in end-to-end relation. Each corner support may be formed by upper and lower telescoping legs to help the canopy structure collapse into a relatively small dimension. Accordingly, each roof support member is preferably dimensioned to have a length approximately the same as an upper leg section of the corner support members. However, if a greater linear in your dimension is desired for the roof support members, each may be formed as extensible members having either hinged or telescoping sections. In either case, structure is provided to releasably lock the roof support members in the extended state.

These and other objects of the present invention will become more readily appreciated and understood from a consideration of the following detailed description of the preferred embodiment when taken together with the accompanying drawings, in which:

DETAILED DESCRIPTION OF THE INVENTION

The present invention relates to movable shelters, and in particular, to canopy structures which may be stored in a compact size yet expanded into an erect structure providing shelter against the elements, or providing privacy for a variety of situational applications. Furthermore, the present invention is directed to such structures that do not require any assembly of parts, and the preferred embodiments of the present invention is particularly directed to such an expandable framework has an automatic erecting roof support structure. Probably, the present invention includes a framework structure which supports a flexible covering across the top thereof, and which may include side panels and the like.

Figure 1:
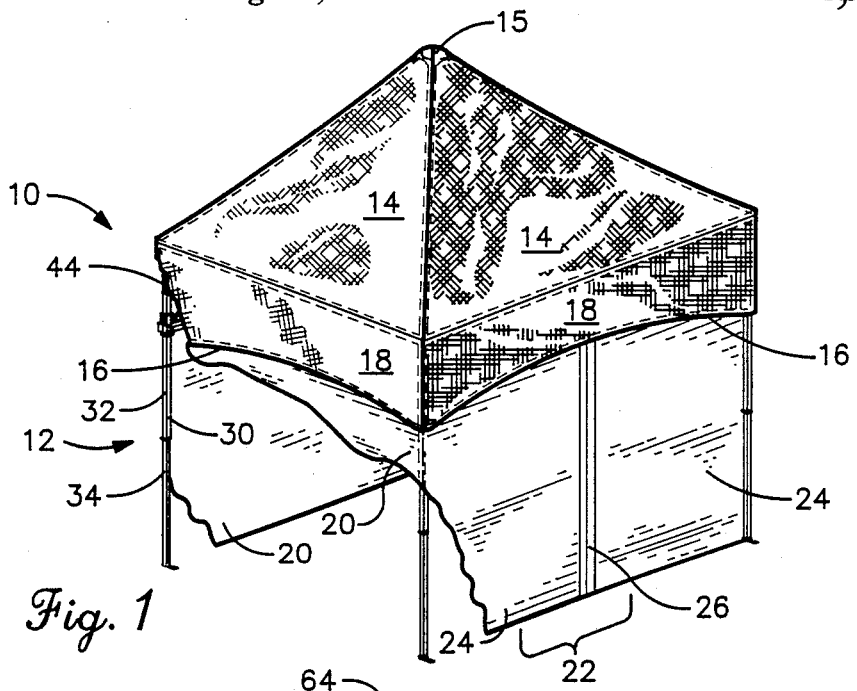
FIG. 1 is a perspective view, partially broken away, of a collapsible canopy shelter according to the preferred embodiment of the present invention.

As is shown in FIG. 1, then, the preferred embodiment of the present invention is in the form of a canopy shelter 10. Canopy shelter 10 includes a framework 12, and a top covering 14 extends across the top of framework 12. Top covering 14 has side margins 18, which extend downwardly alongside framework 12, to a bottom edge 16 of top covering 14. In addition, a front panel 22 may also extend downwardly frame bottom perimeter edge 16 of top covering 14, and may include a pair of partible front panel sections 24, which may be vertically connected to one another by any convenient closure means, such as a zipper 24 to form a doorway. Side and back panels, such as panels 20 may also extend downwardly from bottom edge 16 alongside framework 12. Panels 20 and 22 may be privacy panels that are opaque or translucent, or they may be formed of a protective netting. Panels 20 and 22 along with covering 14 operate to enclose a protected space within canopy shelter 10.

Figure 2:
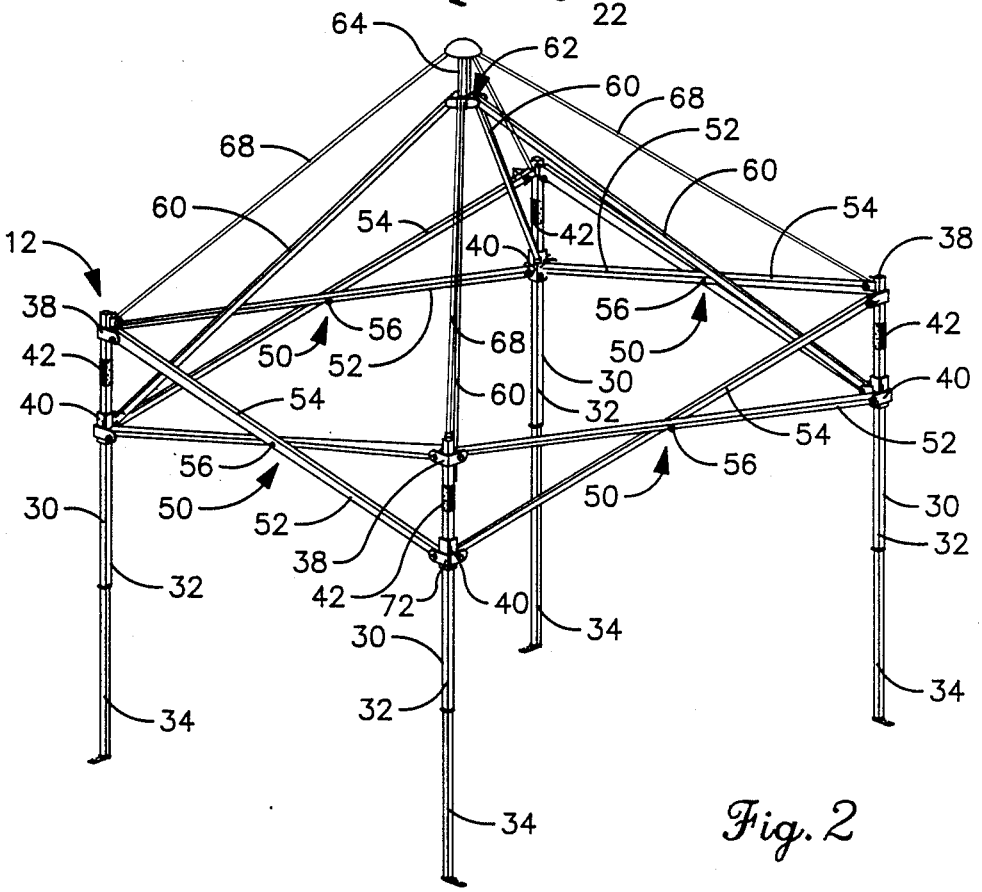
FIG. 2 is a perspective view of the framework assembly used with respect to the canopy shelter shown in FIG. 1.

Framework 12 is best shown in FIG. 2. Here it may be seen that framework 12 has a plurality of corner support members and a plurality of scissor assemblies. The corner support members are in the form of four upright legs 30, each of which includes an upper leg section 32. Each lower leg section 34 which is telescopically received in upper leg section 32. Lower leg section 34 terminates at a bottom end 36 adapted to rest on a support surface, and a top end 38 is located on each leg 30 opposite its respective bottom end so that top end 38 terminates at the top end of upper leg section 32. Each leg 30 includes a slide bracket 40 which is slideably received thereon with each slide bracket 40 being mounted on upper leg section 32. One member of a pair of mating hook-and-loop fasteners is affixed in an upper portion of each upper leg section 32 so that it may be seen that a hook-and-loop fastener 42 is located on each leg 30. Each fastener 42 is adapted to matably engage a cooperative hook-and-loop fastener 44 located along the junction scene between two adjacent side margin portions 18, as shown in FIG. 1.

Figure 4:
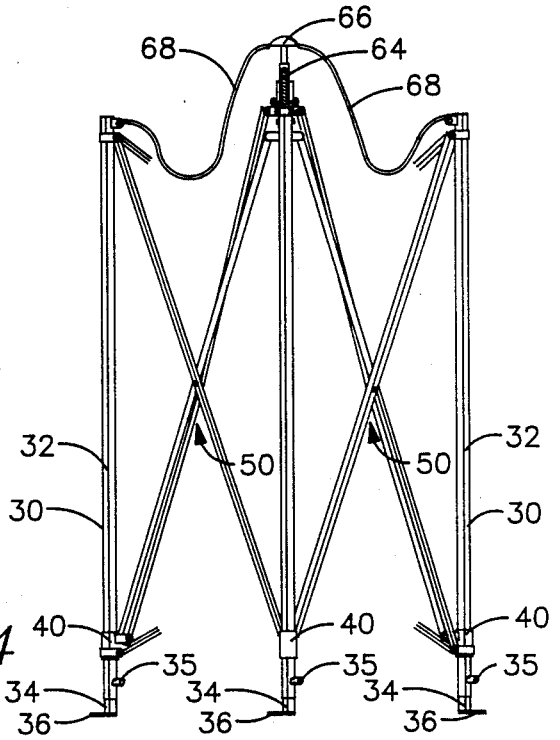
FIG. 4 is a side view in elevation, partially broken away, showing the canopy framework of FIG. 2 in a partially collapsed state.
Figure 5:
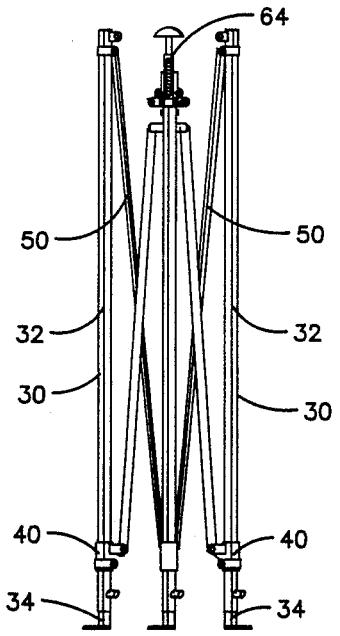
FIG. 5 is a side view in elevation of the canopy structure shown in FIG. 2 in the fully collapsed state.

Adjacent ones of legs 30 are interconnected by respective scissor assembly 50 with each scissor assembly 50 being formed by first and second scissor bars 52 and 54, which are pivotally attached to each other at a common center 56. Scissor assemblies 50 each include a first portion pivotally connected to top end 38 of a respective leg 30, and another portion connected to a respective slide bracket 40 on upper leg section 32. Thus, as is shown in FIG. 2, each first scissor bar 52 has a first end connected to an upper end 38 and an opposite end connected to slide bracket 40 of an adjacent leg 30. Accordingly, scissor assemblies 50 support legs 30 with respect to each other and allow them to collapse from the erect state (shown in FIG. 2), through an intermediate sate (shown in FIG. 4), to a collapsed or stored state (shown in FIG. 5). In the collapsed state, it may be seen that each of legs 30 are oriented in closely spaced apart parallel relation to one another. To this end, slide brackets 40 allow each scissor assembly 50 to contract in a horizontal direction by moving downwardly along a respective leg 30.

In order to support covering 14, a roof support structure is provided in the form of a plurality of roof support members 60. As may be seen in FIGS. 2–4 and 6, roof support members 60 are pivotally secured to one another at first ends thereof at apex 62 of framework 12. Roof support member 60 extend radially outward from one another and are pivotally connected at ends opposite apex 62 to a respective slide bracket 40. Thus, as slide brackets 40 advance upwardly along legs 30, apex 62 is elevated above the support surface upon which framework 12 rests. A center port 64 is connected to each of roof support member 60 at apex 62. Center posts 64 terminates in an upper dome shaped element 66 and a flexible cable 68 interconnects each top end 38 with dome element 66. Cables 68 are preferably elastic cords, but also may be any other type of strong, flexible material such as a metal cable, nylon cord, and the like, which exhibits little elasticity.

Figure 3:
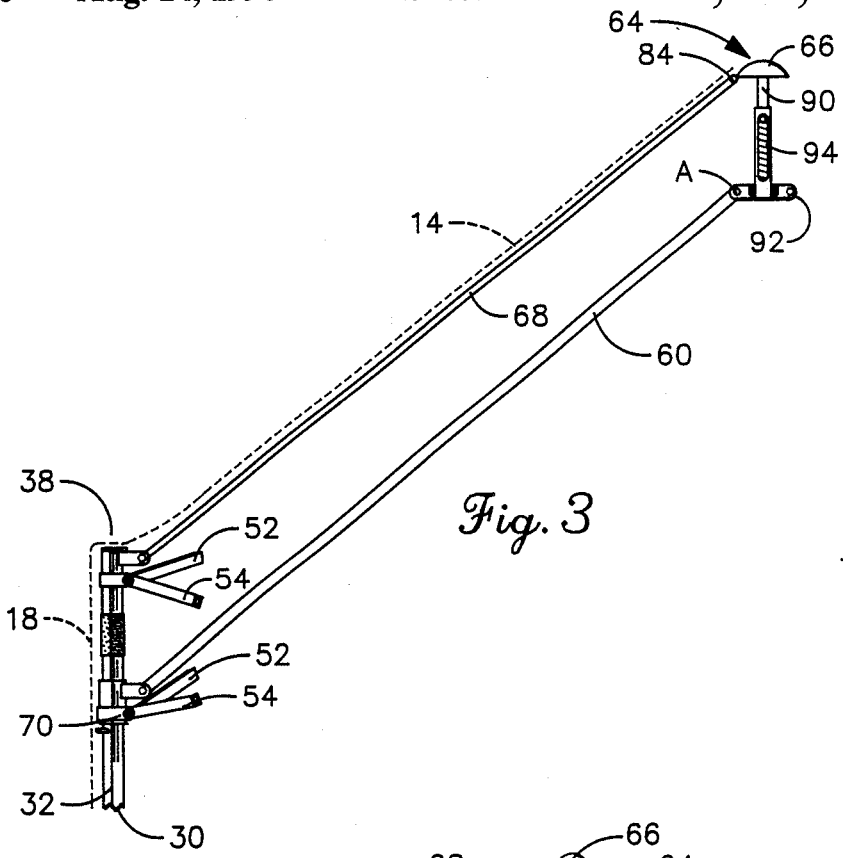
FIG. 3 is a side view in elevation of an upper end of a representative corner support member and roof support member according to the preferred embodiment of the present invention.
Figure 6:
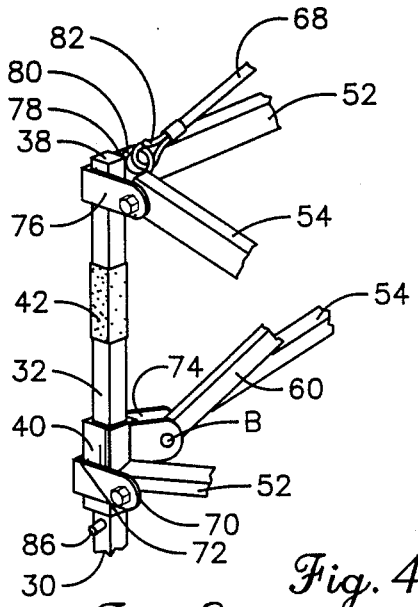
FIG. 6 is an enlarged perspective view, broken away, of an upper end of a corner support member according to the preferred embodiment of the present invention.

The detailed structure of the roof support may be seen better with reference to FIGS. 3 and 6. In these Figures, it may be seen that each slide bracket 40 includes a pair of ears 70 which pivotally attach a first end of first scissor bar 52, and a second pair of ears 72 which pivotally attach a second end of second scissor bar 54. A third set of ears 74 are located above ears 70 and 72 and intermediate thereof so as to pivotally attach a second end of each roof support member 60. At an upper end of upper leg section 32, fourth and fifth sets of ears 76 and 78 are provided. Ears 76 pivotally attach a first end of each second scissor bar 54 while ear 78 pivotally attach a second end of first scissor bar 52. Attachment ring 80 is located between ears 76 and 78 so as to receive attachment clip 82 secured at one end of cable 68. An attachment clip 84 is located at an end of cable 68 opposite clip 82 and is mounted to dome element 66 of center post 64. Each slide bracket 40 is maintained in the position corresonding to the erect state by means of a button latch 86, which is mounted internally of upper leg section 32. Center post 64 may be seen to comprise a bottom bracket portion 88 which telescopically receives rod 90 that is connected to dome shaped element 66. Lower bracket 88 terminates in ears 92 that pivotally attach a first end of each roof support member 60, and bracket 88 houses a spring 94 at resiliently biases rod 90 so that center portion 15 of top cover 14 (shown in FIG. 1) is maintained in a taut condition.

From the foregoing, it may be appreciated that the preferred canopy structure may be stored in a collapsed state, such as shown in FIG. 6. It may, however, be moved to an erect or expanded state, such as shown in FIG. 1, by simply moving legs 30 apart from one another. As leg 30 are moved apart, each scissor assembly 50 opens and each slide bracket 40 correspondingly advances upwardly along its respective upper leg section 32, until it reaches a position wherein it may be latched by a respective button latch 86. Advancement of each slide bracket 40 automatically drives each respective roof support 60 upwardly, and each roof support 60 pivots with respect to a first pivot axis A on center post 64 and a second pivot axis B on a respective slide bracket 40. Thus, apex 62 is automatically elevated. Top cover 14 may then be positioned so that its center 15 is located at apex 62 and so that it extends downwardly and outwardly to each leg 30; side margins 18 then extend downwardly alongside the frame work to terminate at bottom peripheral edge 16. Side margins 18 may be secured in position by hook and loop fasteners 42, 44. In order to maintain top cover 14 taut, cables 68 may then be attached, and the spring force of spring 92 operating on dome shaped structure 66 at center post 64 places tension on the fabric covering. Lower leg sections 34 may then be slid downwardly to be latched into a desired extended state by button latches 35.

It should be appreciated that the above-described preferred embodiment of the present invention is especially suitable for cabana style shelters which may be erected on a rather limited surface area. These cabana style shelters are ideally suited where the surface area to be covered is less than approximately six feet by six feet, although it should be understood that the invention is not restricted to such reduced dimensions. However, in order to provide shelters for larger surface areas, it is often desirable that multiple-connected scissor cells be employed for each scissor assembly and for each roof support to be formed out of an extendible section.

Figure 9:
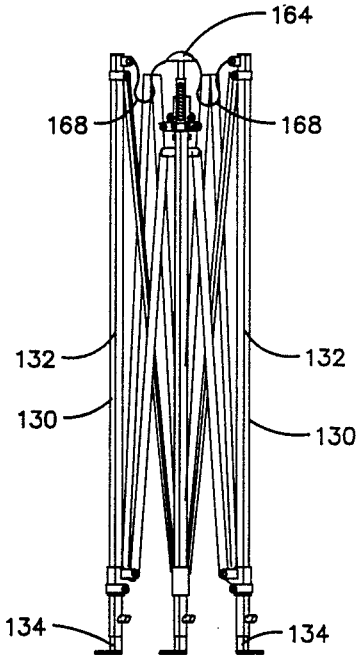
FIG. 9 is a side view in elevation, showing the alternate embodiment of the present invention in a collapsed state without the scissor assemblies.
Figure 8:
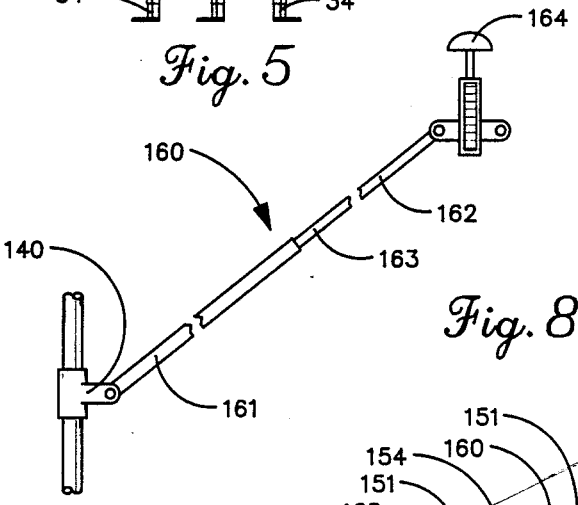
FIG. 8 is a side view in elevation of an alternate embodiment of the roof support member according to the present invention.
Figure 7:
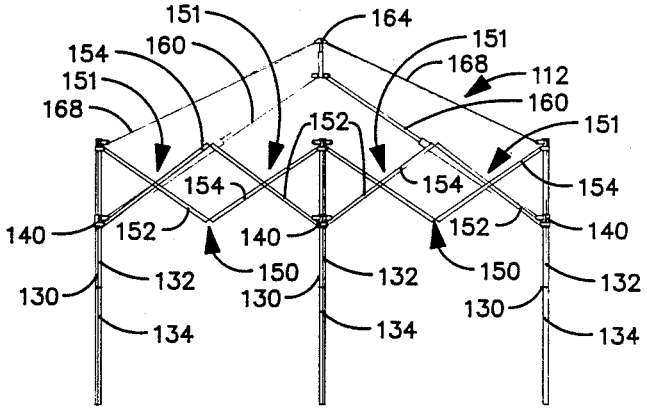
FIG. 7 is a side view in elevation of a first alternate embodiment of the canopy framework according to the present invention.

Thus, for example, as is shown in FIGS. 7–9, the first alternate embodiment of the canopy shelter according to the present invention is depicted. As is shown in FIG. 7, an alternate canopy shelter includes a framework 112 that is adapted to support a top cover. Framework 112 includes a plurality of legs, such as legs 130, formed of upper and lower leg sections 132 and 134 respectively. A slide bracket 140 is mounted on upper section 132 of each leg 130, and a scissor assembly 150 interconnects each adjacent leg 130. Each scissor assembly 150 includes a pair of scissor units 151 constructed by first and second scissor bars 152 and 154. Each scissor assembly 150 is connected in end-to-end pivotal relation so that they may expand and contract together. Further, one portion of each scissor assembly 150 is pivotally connected to top end 138 of each adjacent leg 130, while the other portion of each scissor assembly 150 is connected to the slide brackets 140 on each respective adjacent leg 130.

As in the preferred embodiment, a plurality of roof support members, such as roof support members 160, are pivotally connected to one another at an apex defined by center roof support post 164. At ends opposite post 164, each roof support member 160 is pivotally connected to a respective slide bracket 140. Cables 168 may also extend from roof support post 164 to each top end 138 of respective legs 130.

As is best shown in FIG. 8, each roof support member 160 is formed by a pair of telescoping sections, such as outer telescoping section 161 and inner telescoping section 162. The relative telescopic ability of sections 161 and 162 allow expansion and contraction of each roof support member 160. A button latch 163 is provided to maintain each roof support member 160 in the extended position or open state shown in FIG. 8. The extendibility of each roof support member 160 is provided to accommodate the greater degree of expansion allowable by utilization of multiple scissor units 151 between each leg 130, and thus, to allow coverage of a greater surface area by framework 112 and thus the related canopy shelter. The ability of sections 161 and 162 to contract together into a closed state allows the framework 112 to be stored in a more compact configuration, as shown in FIG. 9.

Expansion from the stored state, is thus relatively simple. This is accomplished by first extending roof support member 160 by moving inner section 162 out of its respective 161 and latching them into position so that center post 164 is elevated. This is undertaken while the framework 112 is in the collapsed or stored state. Legs 130 are then moved apart from one another so that the second ends of each roof support member 160 are moved upwardly corresponding to the upward movement of its respective slide bracket 140. Slide brackets 140 are then latched into the position, as described with respect to the preferred embodiment, and each leg 130 is extended by separating telescoping sections 132 and 134.

Figure 11:
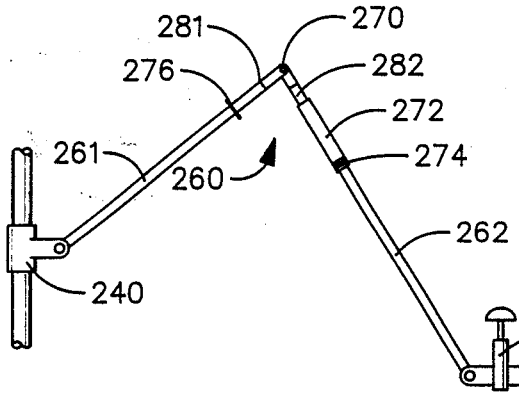
FIG. 11 is a side view in elevation of the roof support member of FIG. 10, in an intermediate, folded state; and, FIG. 12 is a perspective view of an alternate framework assembly according to the present invention.
Figure 10:
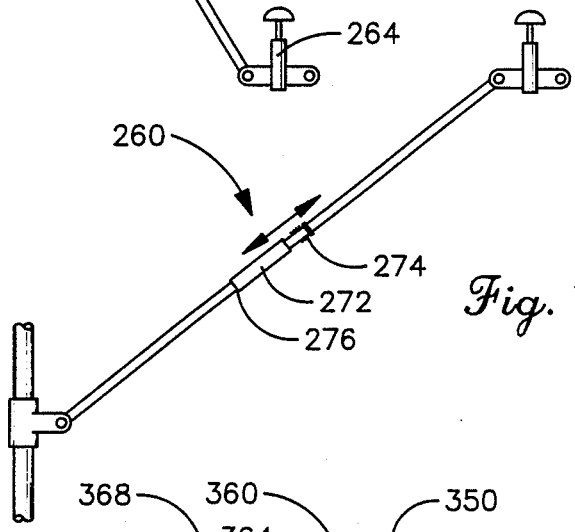
FIG. 10 is a side view in elevation of a second alternate embodiment of a roof support member, in an extended state, according to the present invention.

A second alternate embodiment of the present invention is shown in FIGS. 10 and 11, which shows a modification to the roof support members shown in FIGS. 7–9. In FIGS. 10 and 11, each roof support member 260 is formed by a first pivotal section 261 and a second pivotal section 262, which are pivotally attached to one another by an internal link hinge 270. One end of section 261 is pivotally attached to slide bracket 240 while the end of section 262 opposite hinge 270 is pivotally connected to center post 264. In order to retain each roof support member 260 in a fully extended state or open state, as shown in FIG. 10, a retaining sleeve 272 is provided and is movable between a first limit stop 274 and a second limit stop 276. Thus, when roof support member 260 is moved into the fully extended position shown in FIG. 10, retaining sleeve 270 may be moved toward its respective slide bracket 240 so as to engage the hinged inner ends 281 and 282 of each section 261 and 262 respectively and to lock hinge 270 against pivoting. When it is desired to collapse each roof support member 260 into a folded or closed state, sleeve 272 is moved towards center post 264 so as to expose hinge 270 thus allowing relative pivotal or hinged movement between sections 261 and 262.

Figure 12:
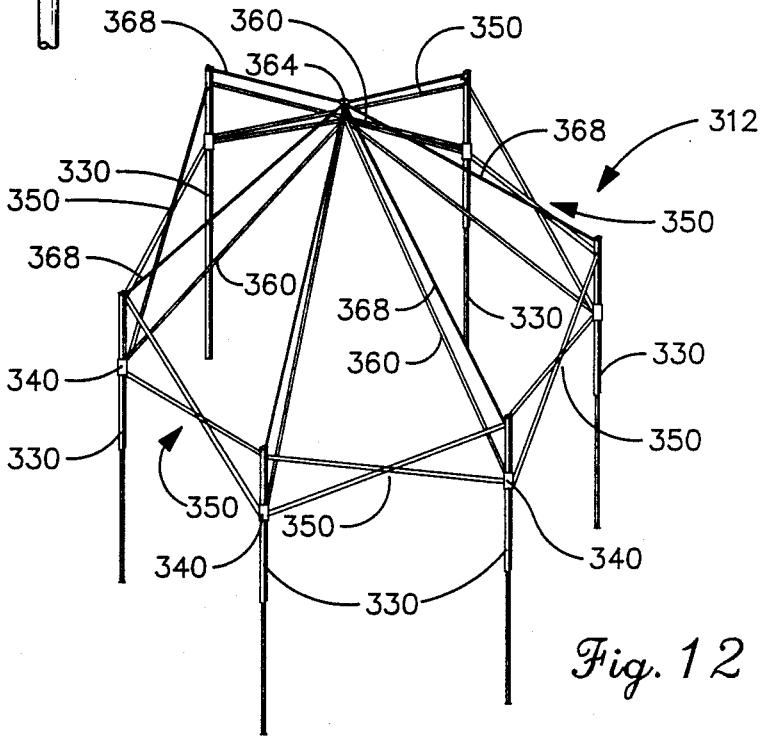

Finally, FIG. 12 shows yet another alternate embodiment of a framework according to the present invention. Here it should be appreciated that the framework is not limited to any specific number of corners, but rather may take on other geometric shapes as well. In FIG. 12, for example, a hexagonally shaped framework 312 is shown having six legs 330 adjacent ones of which are interconnected by means of scissor assemblies 350. Three roof support member 360 extend from a center post 364 defining an apex radially outwardly to one another to be attached to respective slide brackets 340 on every other leg 330. Roof support members 360 are preferably extendible roof support members such as shown in FIGS. 8 or 10, and are typically extendible due to the increased radial distance resulting from a larger surface area covered by framework 312 when the number of legs 330 and scissor assemblies 350 are employed. Accordingly, each scissor assembly 350 is pivotally connected at respective top ends of adjacent legs 330 and at another portion to the respective slide brackets 340 on each of legs 330, including each leg 330 that is not connected to a roof support member 360. Cables 368 may then extends from center post 364 to the upper end of each leg 330. A suitably configured top cover is then provided for framework 312.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A canopy structure adapted to be folded and stored in a collapsed state and erected in an expanded state on a support surface, comprising:

a plurality of upright corner support members each having a bottom end positionable on the support surface and a top end opposite said botton end, said corner support members oriented alongside one another in the collapsed state and movable outwardly apart from one another toward the expanded state wherein said corner support members are oriented generally vertically of the support surface;

a slide bracket slideably mounted on each corner support member;

a scissor assembly interconnecting adjacent ones of said corner support members, each respective scissor assembly having one portion pivotally connected to the top ends of its associated corner support members and another portion pivotally connected to the slide brackets of its associated corner support members, said scissor assemblies each operative to open and close when the associated corner support members move away from and toward one another, each said slide bracket advancing to a location proximate the top end of its respective corner support member when said corner support members are moved into the expanded state and moving toward the bottom end of its respective corner support member when said corner support members are moved toward the collapsed state;

a plurality of roof support members pivotally connected to one another at first ends thereof to form an apex, each roof support member pivotally connected at a second end thereof opposite the first end to the slide bracket on a respective corner support member whereby advancement of said slide brackets to locations proximate the top ends of the corner support members as said canopy structure is moved toward the expanded state causes the apex to be elevated with respect to the support surface; and latch means for retaining each said slide bracket in the location proximate the top end of its respective corner support member.

2. A canopy structure according to claim 1 including a flexible covering size to extend across and be supported by said roof support members to form a top for said canopy structure, said covering having perimeter edge portions extending between the top ends of adjacent ones of said corner support members.

3. A canopy structure according to claim 2 including side panels extending downwardly from the perimeter edge portions of said flexible covering to define sides for the canopy structure thereby enclosing a protected space.

4. A canopy structure according to claim 3 wherein one of said side panels is formed by a pair of partible sections to define a front panel with a doorway.

5. A canopy structure according to claim 4 including closure means for releaseably joining said partible sections.

6. A canopy structure according to claim 2 wherein said covering includes a peak portion positionable over said apex and operative to exert a downward force on said apex.

7. A canopy structure according to claim 6 including a plurality of cable means extending between the apex and each top end of said corner support members for supporting said covering there along.

8. A canopy structure according to claim 7 wherein each said cable means is defined by an elastic cord.

9. A canopy structure according to claim 8 wherein said elastic cords are each releasably securable to one of said apex and the top end of the respective corner support member.

10. A canopy structure according to claim 9 wherein each said roof support members are constructed out of at least first and second sections.

11. A canopy structure according to claim 10 wherein said first and second sections are constructed as inner and outer telescoping sections movable between a telescoped relation defining a closeed state and an extended relation defining an open state.

12. A canopy structure according to claim 11 including releasable locking means for retaining said inner and outer telescoping sections in the open state.

13. A canopy structure according to claim 10 wherein said first and second sections are hingedly connected to one another and are pivotable between a closed state and an open state.

14. A canopy structure according to claim 13 including releasable locking means for retaining said first and second sections in the open state.

15. A canopy structure according to claim 1 wherein said apex includes a center post assembly pivotally connected at a lower end to the first ends of said roof support members.

16. A canopy structure according to claim 1 wherein each said scissor assembly is constructed of a plurality of scissor units.

17. In a collapsible canopy shelter including an expandible framework structure having a plurality of legs interconnected by scissor assemblies wherein each scissor assembly has one portion pivotally connected to top ends of its associated legs and another portion pivotally connected to a slide bracket on each of its associated legs whereby the scissor assemblies open and close and the slide brackets move toward and away from the top ends of the legs as the framework is expanded from a collapsed state to an expanded state and including a flexible covering extending across the framework to define a roof. Therefore, the improvement comprising a plurality of roof support members pivotally connected to one another at first ends thereof to form a central apex portion of said covering and pivotally connected at second ends thereof opposite said first ends to respective ones of said slide brackets whereby movement of the slide brackets toward the top ends of their respective legs operates to elevate said central apex portion.

18. The improvement according to claim 17 further including a flexible cable extending from the top end of each leg to the apex portion.

19. The improvement according to claim 17 wherein each of said roof support members includes first and second sections extendible with respect to one another.

20. The improvement according to claim 19 wherein said first and second sections telescope together in a closed state and extend to an open state.

21. The improvement according to claim 20 include latch means for retaining said first and second sections in the open state.

22. The improvement according to claim 19 wherein said first and second sections pivot with respect to one another between a folded, closed state and extend to an open state.

23. The improvement according to claim 22 including latch means for retaining said first and second sections in the open state.

* * * * *

UNITED STATES PATENT AND TRADEMARK OFFICE

CERTIFICATE OF CORRECTION

PATENT NO. : 4,947,884

DATED : August 14, 1990

INVENTOR(S) : James P. Lynch

It is certified that error appears in the above-identified patent and that said Letters Patent is hereby corrected as shown below:

In the Abstract, line 23, delete "open", substitute --opened--.

Column 1, line 27, delete "are", substitute --area--;

line 27, delete "rood", substitute --roof--.

Column 2, line 27, delete "#767", substitute --#676--.

Column 3, line 44, delete "buttom", substitute --button--.

Column 4, line 46, delete "state.", substitute --state;--.

Column 5, line 25, delete "frame", substitute --from--;

line 29, delete "24", substitute --26--.

Column 6, line 3, delete "sate", substitute --state--.

Column 8, line 64, delete "extends", substitute --extend--.

UNITED STATES PATENT AND TRADEMARK OFFICE

CERTIFICATE OF CORRECTION

PATENT NO. : 4,947,884

DATED : August 14, 1990

INVENTOR(S) : James P. Lynch

It is certified that error appears in the above-identified patent and that said Letters Patent is hereby corrected as shown below:

Column 10, line 24, delete "closeed", substitute --closed--;

line 55, delete "roof. Therefore", substitute --roof therefor, the--.

Signed and Sealed this

Sixteenth Day of March, 1993

*Attest:*

STEPHEN G. KUNIN

*Attesting Officer*

*Acting Commissioner of Patents and Trademarks*